US005119514A

United States Patent [19]

Woehl

[11] Patent Number: 5,119,514

[45] Date of Patent: Jun. 9, 1992

[54] EAR SHIELD CAP

[76] Inventor: William L. Woehl, Rte. 5, Box 5075, San Angelo, Tex. 76904

[21] Appl. No.: 593,059

[22] Filed: Oct. 5, 1990

[51] Int. Cl.[5] ..... A42B 1/02

[52] U.S. Cl. ..... 2/195; 2/197

[58] Field of Search ..... 2/171, 171.4, 171.5, 2/171.6, 171.7, 171.8, 195, 196, 197

[56] References Cited

U.S. PATENT DOCUMENTS

| | | | |
|---|---|---|---|
| 2,218,947 | 10/1940 | Brunzell | 2/195 |
| 2,629,869 | 3/1953 | Locken | 2/197 |
| 2,869,134 | 1/1959 | Milstein | 2/195 |
| 3,077,607 | 2/1963 | Bregenzer | 2/195 |
| 3,346,876 | 10/1967 | Hutton | 2/195 |
| 3,945,050 | 3/1976 | Bohash | 2/197 |
| 4,023,212 | 5/1977 | Huffman | 2/197 |
| 4,485,495 | 12/1984 | Lunt | 2/195 |
| 4,815,148 | 3/1989 | Satterfield | 2/197 |
| 4,839,924 | 6/1989 | Laurence | 2/195 |
| 4,845,782 | 7/1989 | Gregg | 2/197 |
| 4,896,375 | 1/1990 | Colucci | 2/195 |

FOREIGN PATENT DOCUMENTS

| | | | |
|---|---|---|---|
| 1141102 | 2/1983 | Canada | 2/196 |
| 1172804 | 8/1984 | Canada | 2/195 |
| 585529 | 3/1977 | Switzerland | 2/195 |

*Primary Examiner*—Werner H. Schroeder
*Assistant Examiner*—Diana L. Biefeld
*Attorney, Agent, or Firm*—Milburn & Peterson

[57] ABSTRACT

An ear shield cap suitable for shading the wearer's eyes and ears from direct exposure to the rays of the sun which may be adjustable for a number of usual head sizes without undue affect on the shading function. The cap has a visor extending from the front of the crown, a pair of ear shields extending from the sides of the crown and the rear of the crown is free of any extension and structured to adust the cap to the head size of various wearers. The visor and ear shields are joined to provide a uniform transition from a visor to the ear shields. The cap may include a rear gore or panel in the crown of stretchable material to provide size adjustment or the rear of the crown may have a cutout which is bridged or spanned by a tab which may be an elastic band, a mating velcro fastener or a snap fastener adjustable to variable lengths. The cap may be of the baseball cap type construction made with materials and features permitting air circulation about the wearer's head.

3 Claims, 2 Drawing Sheets

EAR SHIELD CAP

BACKGROUND OF THE INVENTION

The present invention relates generally to an improved cap structure, and more particularly to an improved sun guard cap having a typical baseball cap configuration, and with one cap being adapted to accommodate a variety of size heads.

The cap structure of the present invention is further provided with ear shields or wings which extend outward from the crown over the ears of the wearer at an angle to provide shading from the direct rays of the sun. The cap may be constructed in typical fashion with cloth panels or gores. If desired, the cap may have a number of axially stretchable gores to enhance the comfort of the cap and avoid a tight-fitting structure. The rear panel or gore of the crown may be cut out to form an air passage as well as an adjustable headband. The structure of the present invention permits shading not only the eyes, but also the ears from the direct rays of the sun in multi-size cap structures which are comfortable for the wearer, and with a size range of the cap being adaptable for use by all persons with heads within a number of usual sizes.

In the past, attempts have been made to provide a wide variety of multi-size cap structures of the baseball cap style, and such caps are in wide-spread use today. Typically, multi-size caps are created through the utilization of a variable-length snap arrangement which permits the user to adjust the cap size as required. Such caps, normally, do not include ear shields or wings. However, caps of the baseball cap type or style have been made wherein ear flaps when folded down over the wearer's ears provide an added degree of comfort to the wearer during unseasonable weather, including cold weather with precipitation in the form of either rain or snow. Such flaps may be folded over the crown and secured to expose the wearer's ears when desired in less cold weather. Such caps are frequently of the single or fixed size variety. See U.S. Pat. No. DES 301,282 to Satterfield, May 30, 1989. Further, cap constructions are disclosed in U.S. Pat. No. 2,869,134, granted to Milstein Jan. 20, 1959, and U.S. Pat. No. 3,077,607, granted to Bregenzer Feb. 19, 1963. Also, U.S. Pat. No. 2,629,869 issued Mar. 3, 1953 to Locken discloses a sun visor to protect the eyes of the wearer, however, no protection for the ears of the wearer is disclosed.

The widespread appeal of caps of the baseball cap style is well known, however, such caps provide little, if any, protection to the wearer's ears from direct rays of the sun. Farmers outside during the heat of the day are quite susceptible to sunburned ears, yet the old straw hat leaves something to be desired. Hats with circular brims suffer from the wearer leaning back against a headrest or the like knocking the hat off. The present invention overcomes these problems by providing a cap with a visor of desired area and ear shields of desired area to protect, respectively, the eyes and ears of the wearer from the direct rays of the sun.

Unfortunately, caps such as the present invention with ear shields or wings to protect wearers (such as farmers) typically active in the summer sun have not been forthcoming.

It will be understood that caps of the baseball cap style are marketed in a variety of ways. These caps are marketed through conventional retail outlets, and have also found a substantial market as promotional items. In the marketing of outer wear products, it is, of course, more economical to provide such products with a minimal number of sizes. Thus, economy of numbers may be achieved through utilization of caps of the multi-size variety.

In addition to typical marketing, various types of business entities provide such promotional items to employees and/or customers, and in these instances, the outer surface of the crown at a point above the visor may carry an emblem, or other indicia identifying the business entity. Because of the manner in which these products are marketed, it is, or course, desirable to utilize the products with minimal size variation requirements, hence the multi-size caps become extremely desirable for the customer.

As is conventional, baseball caps employ a crown portion to which a visor is secured to the forward edge of the crown and extends outwardly therefrom, however, these caps fail to provide sun protection for the wearer's ears.

In utilization of caps for outer wear, it is desirable for the forward portion to be somewhat rigid so that, for appearance purposes, the crown portion stands somewhat erect. Also, such an arrangement will normally provide a means for the visor portion to be rigid, durable, and extend generally forwardly of the wearer's forehead. Accordingly, the front gores or panels may be fitted and/or stiffened by suitable means in order to stand generally erect during wear.

Panels or gores forming the rear portion of the crown may be stretchable, a woven cloth normally being employed. Such cloth structures typically have a synthetic resin foam fiber forming the fabric layers. The weave of the fabric layers is such that the cloth is stretchable in the peripheral direction of the cap structure. In other words, the stretch occurs along the direction of the headband or edge-band of the cap. Such material is utilized in selected gores only of the multi-size cap structures and thereby assist in achieving an accommodation of wearers with heads of various sizes together with the fitted front portion. The combination of the rear crown portion fabricated with the stretchable fabric, and with the front portions being formed of non-stretchable, somewhat rigid fabric provides a desirable combination of properties for the cap. Further, such a structure permits the ear shields and visor to retain the selected angle for the desired shading of the eyes and ears from the direct rays of the sun while adjusting for the wearer's head size.

As described in U.S. Pat. No. 4,612,007 to Lipkin, for the purposes of achieving substantially universal utilization with a single size cap structure, the material forming the gores for the rear crown portion is selected so that it is capable of a 20 percent stretch along one axial direction. Such materials are, of course, commercially available. For those instances when more than one size cap structure will be employed to accommodate all wearers, a uniaxial stretch of up to about 10 percent is normally found to be satisfactory.

As indicated, the forward portion of the cap will be provided with a visor or bill, with the visor normally being positioned above the eyes and forehead and with ear shields above ears of the wearer. The visor and ear shields may be of a material which is non-stretchable or non-elastic. Even considering the requirements of the presence of the visor or bill and ear shields, along with the adjacent portion of the crown being fabricated of non-stretch fabric, together with the constraint on the number of sizes to be stocked so as to accommodate wearers with heads of usual sizes, the cap structure of the present invention has been found to accommodate these desirable features.

Where maximum air circulation is desired, a loose weave crown may be used with a rear cut-away which is spanded along the headband line by a variable length tab which may include a snap arrangement or velcro for a closure.

The structure of the present invention permits a cap to be designed which is attractive in use, comfortable for the wearer, and further provides the advantageous feature of protection for the wearer's ears and eyes from the direct sun rays. Such cap designs are useful to individuals for a variety of outdoor purposes, including work purposes such as farming, as well as sport purposes, including such sports as hunting, fishing, golfing and the like.

SUMMARY OF THE INVENTION

Therefore, it is a primary object of the present invention to provide an improved baseball-type cap employing ear shields to protect the wearer's ears from the direct rays of the sun.

It is a further object of the present invention to provide a baseball-type cap structure having ear shields or wings adjustable for various sizes, which can be manufactured utilizing conventional materials and fabrics, and which is both functional and attractive in its use and appearance.

It is yet a further object of the present invention to provide an improved sun protective cap structure of the baseball-cap style, which employs outwardly extending ear shields to protect the wearer's ears from direct exposure to rays from the sun while providing a conventional visor.

Other and further objects of the present invention will become apparent to those skilled in the art upon a study of the following specification, appended claims and accompanying drawings.

IN THE DRAWINGS

DESCRIPTION OF THE PREFERRED EMBODIMENT

Figure 1:
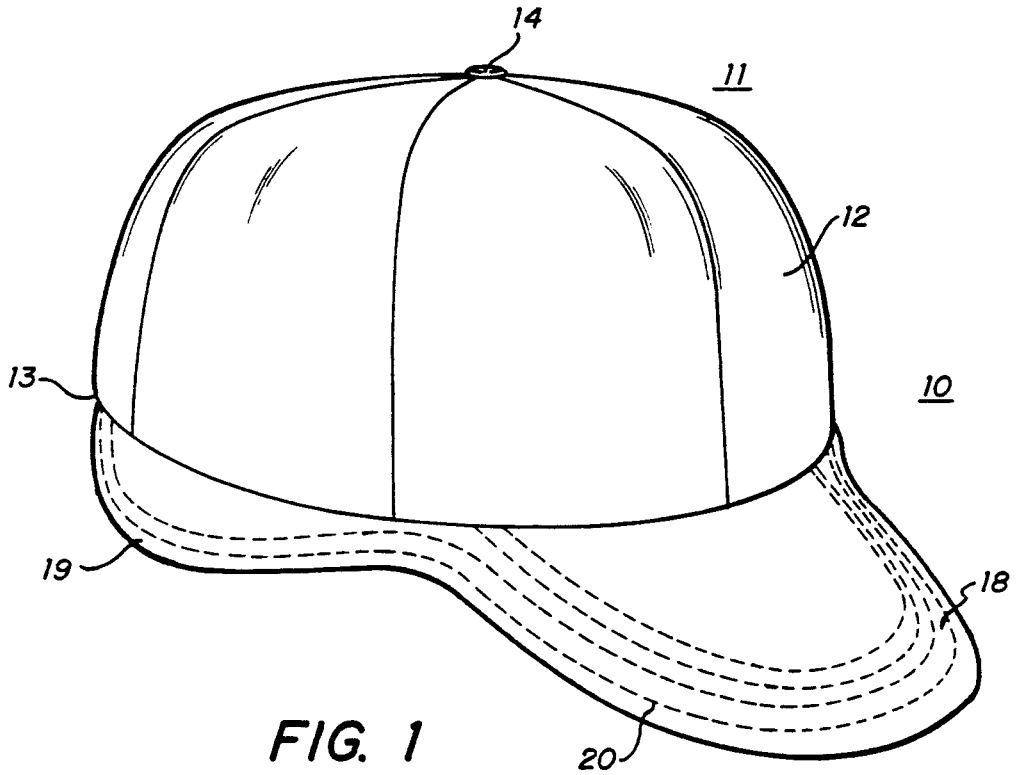
FIG. 1 is a perspective view of the Ear Shield Cap made in accordance with the present invention.
Figure 2:
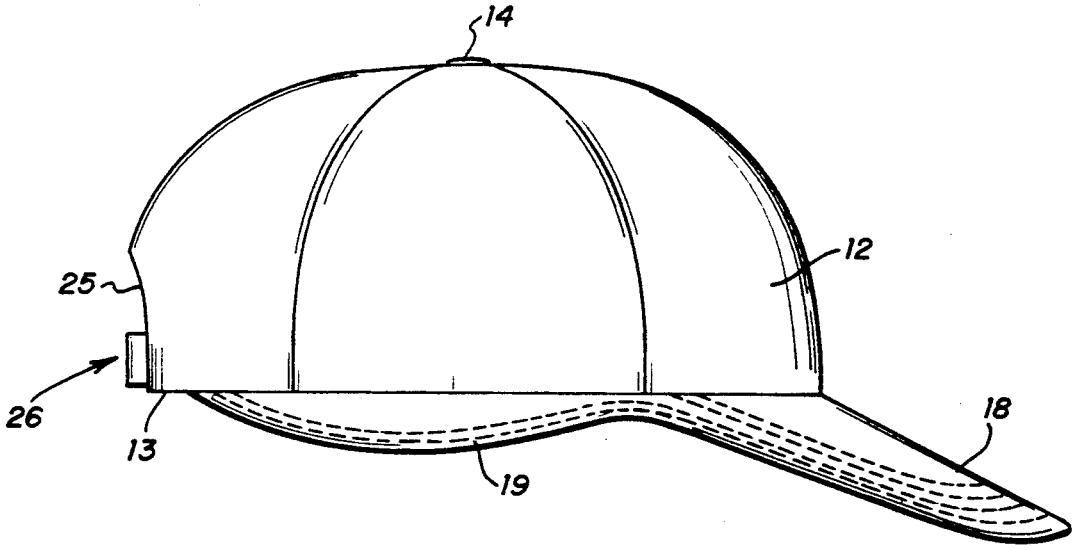
FIG. 2 is a side elevation view of the Ear Shield Cap.

In accordance with the preferred embodiment of the present invention, and with attention to the drawings, particularly FIGS. 1 through 4, the cap generally designated 10 has a crown 11 which is fabricated with several fabric segments 12 forming a headband line 13 and With a button 14 at the top. Secured to the headband line 13 is the visor 18 and ear shields 19 extending away from the crown 11 at a desirable angle or tilt. This tilt provides shading of the eyes and ears from direct exposure to rays of the sun. The visor 18 and ear shields 19 may be an integral brim as shown or separate and distinct parts which may have different tilts.

For appearance and reinforcement the visor 18 and ear shields 19 have a series of spaced stitch line 20 extending along the border area of the visor 18 and ear shields 19 terminating at the headband line 13.

The visor 18 and ear shields 19 may be secured to the crown 11 along headband line 13 in any suitable manner as used in present cap manufacturing.

Figure 3:
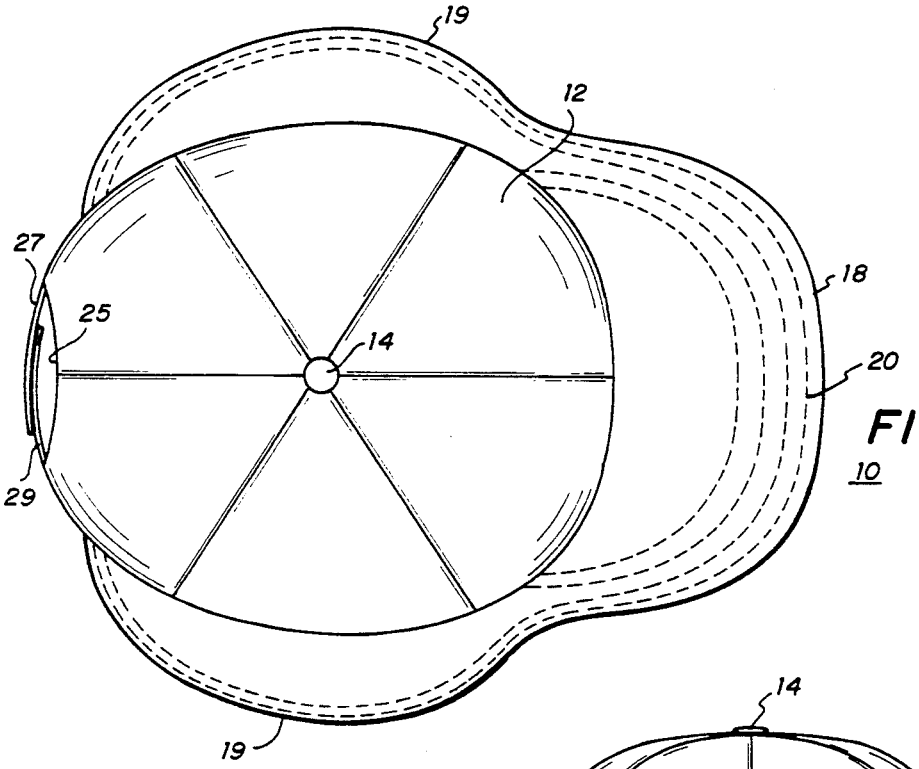
FIG. 3 is a top view of the Ear Shield Cap illustrating the relationship between the visor and ear shields.
Figure 4:
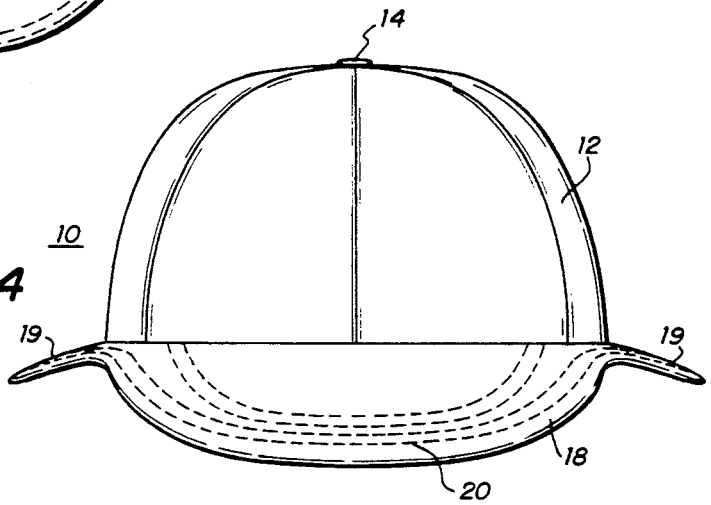
FIG. 4 is a front elevation view of the Ear Shield Cap illustrating a possible tilt to the visor and ear shields.
Figure 5:
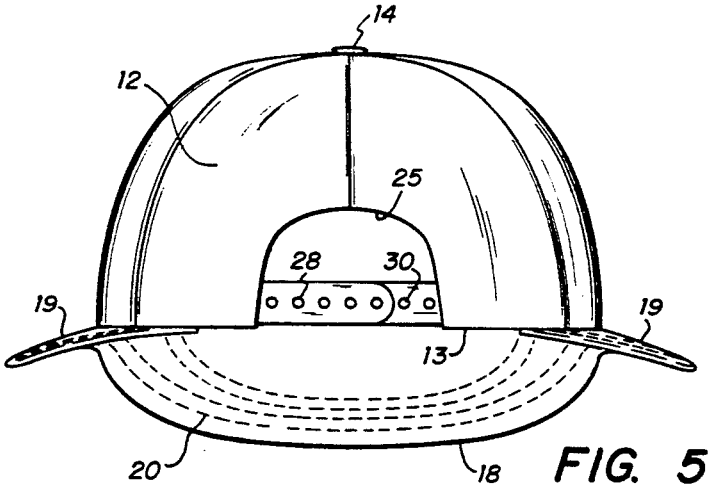
FIG. 5 is a rear elevation view of the Ear Shield Cap illustrating the crown cut-away to accommodate an adjustment band in the headband line.
Figure 6:
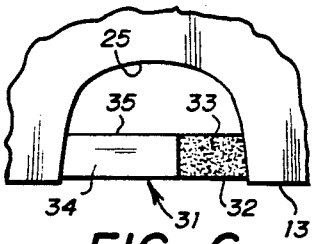
FIG. 6 is a breakaway segment of rear elevation view of FIG. 5 illustrating a different adjustment band construction.

Referring particularly to FIGS. 3 and 5, the crown 11 is cut out at the rear of the cap 10 along margin 25 from the headband line 13 forming an arch-shaped opening. A fastener generally 26 at the bottom of the arch-shaped opening formed by margin 25 provides an adjustment band attaching each side of cap 10 together in the rear along the headband line 13. The fastener 26 comprises a band or strap 27 having spaced eyelets 28 therein and a band or strap 29 having spaced nodules 30 therein. Strap 27 and strap 29 are mated to each other. The series of nodules 30 are snapped into a different series of eyelets 28 to size the cap 10 to a particular wearer. An alternate fastener generally 31 in FIG. 6 comprises a two-piece Velcro® band or strap which is a well known type of fastener. The fastener 31 has band 32 which has loops 33 and band 34 which has pile material 35.

It will be appreciated that various changes and modification may be made in the above described EAR SHIELD CAP without departing from the scope of the invention which is limited only by the scope of the following claims.

What is claimed is:

1. An ear guard cap or the like comprising;

a crown portion having a visor segment, an ear segment and a rear segment, forming an opening for the wearer's head and defining a headband line and constructed to allow air circulation throughout the crown to the wearer's head, a visor extending forward from the headband line and integral with the visor segment of the crown portion set at an angle to shade the wearer's eyes from the direct rays of the sun while otherwise maintaining relatively unobstructed vision, a pair of ear sun shields extending outward from the headband line at the respective sides of the ear segment of the crown portion joining with the visor segment at the headband line and forming an arcuate periphery between each of the ear sun shields and the visor and joining with the rear segment of the crown portion and forming an arcuate periphery between each of the ear sun shields and the headband line of the rear segment; said ear sun shields extending from the headband line approximately one-half the extension of the visor from the headband line providing protection to the wearer's ears from the direct ray of the sun.

2. A cap or the like comprising:

a crown of relatively inextensible material defining a headband line and having a rear section with a cut-away therein, adjustable means for sizing the cap and at least in part closing the cut-away in the rear section, said adjustable means exclusing expandable material, a visor extending outward from the headband line of the front portion of the crown, a pair of ear sun shields extending outward from the headband line on each side of the crown about one-half of the visor extension, joining with the visor near the headband line and forming an arcuate periphery between each of the ear sun shields and the visor, and joining at the headband line with the rear section of the crown and forming an arcuate periphery between each of the ear shields and the headband line of the rear section, said ear sun shields providing protection to the wearer's ears from the direct rays of the sun.

3. A cap or the like comprising:

a crown of relatively inextensible material defining a headband line and having a rear section with a cut-away therein, means including expandable material for automatically adjusting the cap size to the wearer and, at least in part, closing the cut away in the rear section, a visor extending outward from the headboard line of the front portion of the crown, a pair of ear sun shields extending outward from the headband line on each side of the crown about one-half of the visor extension, joining with the visor near the headband line and forming an arcuate periphery between each of the ear sun shields and the visor, and joining at the headband line with the rear section of the crown and forming an arcuate periphery between each of the ear shields and the headband line of the rear section, said ear sun shields providing protection to the wearer's ears from the direct rays of the sun.

* * * * *